US008591384B2

(12) United States Patent
Marji

(10) Patent No.: US 8,591,384 B2
(45) Date of Patent: Nov. 26, 2013

(54) VARIABLE WEIGHT DEVICE FOR EXERCISING THE HANDS, WRISTS, ARMS AND FINGERS

(76) Inventor: Sammy Black Marji, Yonkers, NY (US)

( * ) Notice: Subject to any disclaimer, the term of this patent is extended or adjusted under 35 U.S.C. 154(b) by 163 days.

(21) Appl. No.: 13/373,380

(22) Filed: Nov. 14, 2011

(65) Prior Publication Data

US 2013/0123072 A1 May 16, 2013

(51) Int. Cl.
*A63B 23/16* (2006.01)
*A63B 23/14* (2006.01)

(52) U.S. Cl.
USPC ..... 482/50; 482/45; 482/47; 482/49

(58) Field of Classification Search
USPC ..... 482/44–51, 92–94, 114–115, 118, 98, 482/106, 139
See application file for complete search history.

(56) References Cited

U.S. PATENT DOCUMENTS 3,612,521 A * 10/1971 Wendeborn ..... 482/48
4,750,734 A * 6/1988 Greenfield ..... 482/47
4,828,249 A * 5/1989 Keating ..... 482/48
4,929,211 A * 5/1990 Resnick et al. ..... 446/14
5,045,011 A * 9/1991 Lovik ..... 446/46
5,062,625 A * 11/1991 Vonk ..... 482/48
5,366,436 A * 11/1994 Gibney ..... 601/40
5,536,195 A * 7/1996 Stamos ..... 446/48
6,228,001 B1 * 5/2001 Johnson et al. ..... 482/48
2012/0053024 A1 * 3/2012 Mendoza ..... 482/106

* cited by examiner

*Primary Examiner* — Oren Ginsberg
*Assistant Examiner* — Andrew S Lo

(57) ABSTRACT

An exercise device comprising a bottom support plate and a mounting bolt affixed thereto and having an externally threaded vertical stem, one or more plates superposed on the bottom support plates, each plate having a central bore through which extends said vertical stem. A hand gripped uppermost plate has a lower surface in mating relation with the top plate, a central internally threaded bore in said lower surface of the hand grip plate for threadedly engaging the end of said externally threaded stem. A dome shaped palm support on the upper surface of the hand grip plate and five finger gripping holes on the supper surface of the hand grip palm support plate around the dome shaped palm support sized for inserting the fingers of the exerciser and to lift and lower the device during exercise.

3 Claims, 2 Drawing Sheets

VARIABLE WEIGHT DEVICE FOR EXERCISING THE HANDS, WRISTS, ARMS AND FINGERS

FIELD OF THE INVENTION

This invention relates generally to a device for exercising the hands, wrists, arms and fingers and is particularly related to a variable weight exercising device for strengthening the hand, wrist and fingers and which is useful for physical therapy.

BACKGROUND OF THE INVENTION

Several devices are in common use for therapy and rehabilitation of the hands, arms, wrists and fingers. These devices are often used in gyms and rehabilitation facilities and even in various homes, and are usually relatively simple to use without supervision by a trainer. There are several prior art patents which disclose and describe such exercising devices such as, for example, U.S. Pat. No. 4,730,827 issued Mar. 15, 1988 which describes a hand rehabilitation device comprising a planar dish having a spread apart circumferential necessary for receiving the fingers with the thumb inserted through selected apertures.

Another exercising device is described in U.S. Pat. No. 6,288,001 B1 issued May 8, 2001. This device comprises an elastomeric dish-like body having a plurality of spaced apart apertures for receiving the thumb and fingers and a convex enlargement extending from at least one surface positioned inward of the apertures. In use, the device is inserted over the ends of the fingers and the thumb. Other prior art exercising devices are described in U.S. Pat. Nos. 5,366,436; 4,838,249; 5,062,625 and 4,750,734 referred to in the above-mentioned patent.

Thus, while several devices are available in the prior art, none of them disclose a variable weight exercising device for the hands, wrists, arms and fingers which permits adjusting the weight of the exercise device to suit the individual strength.

It is therefore an object of the present invention is to provide a variable weight exercise device for strengthening the hands, wrists, arms and fingers of the user.

It is a further objet of the present invention to provide such exercising device which is simple to use and which can be varied in weight and dimensions by the user.

The foregoing and other advantageous features of the device of this invention will be more clearly understood from the following detailed description and accompanying drawings.

SUMMARY OF THE INVENTION

An exercise device is provided for the hands, wrists, arms and fingers of an exerciser which comprises several superposed plates of predetermined size, weight and dimension. Each plate has a central hole which is aligned with the hole in the adjacent plate. The bottom support plate has a mounting bolt affixed thereto and an externally threaded stem has its lower end affixed to the mounting bolt and extends vertically through the aligned holes. A hand gripped upper plate has its bottom surface resting in mating relation to the upper surface of the top plate of said plurality of superposed plates and includes a central hole aligned with said other aligned hole and is internally threaded so as to threadedly engage the upper end of the externally threaded stem. The top surface of said hand gripped plate has a central dome adapted to be held within the palm of the exerciser's hand, and a plurality of finger gripping holes are distributed around the down shaped palm support for inserting the fingers of the exerciser to assist in lifting the device during exercise.

BRIEF DESCRIPTION OF THE DRAWINGS

In the drawings, wherein like reference numerals are employed to designate like parts.

DETAILED DESCRIPTION OF THE INVENTION

Figure 1:
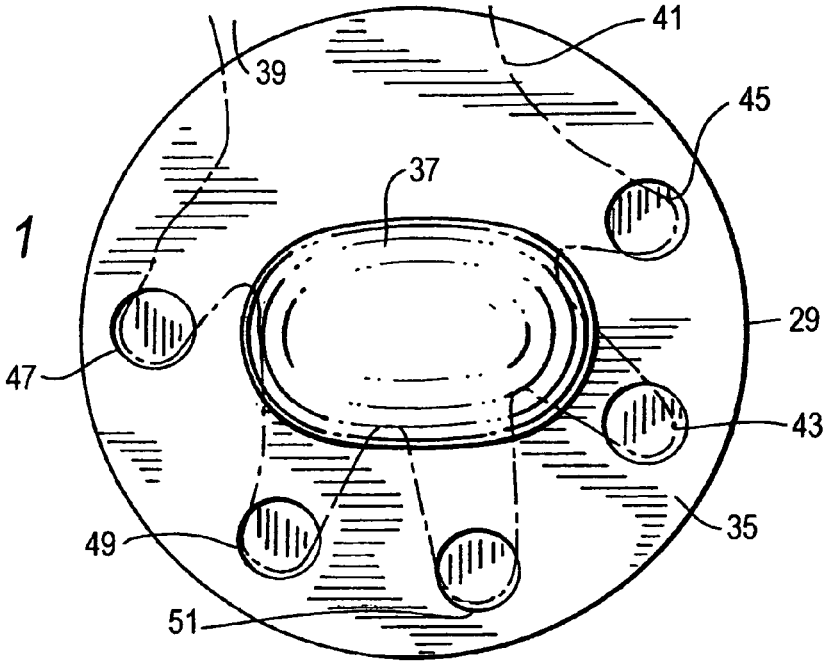
FIG. 1 is a top view of the exercise device of the present invention.
Figure 2:
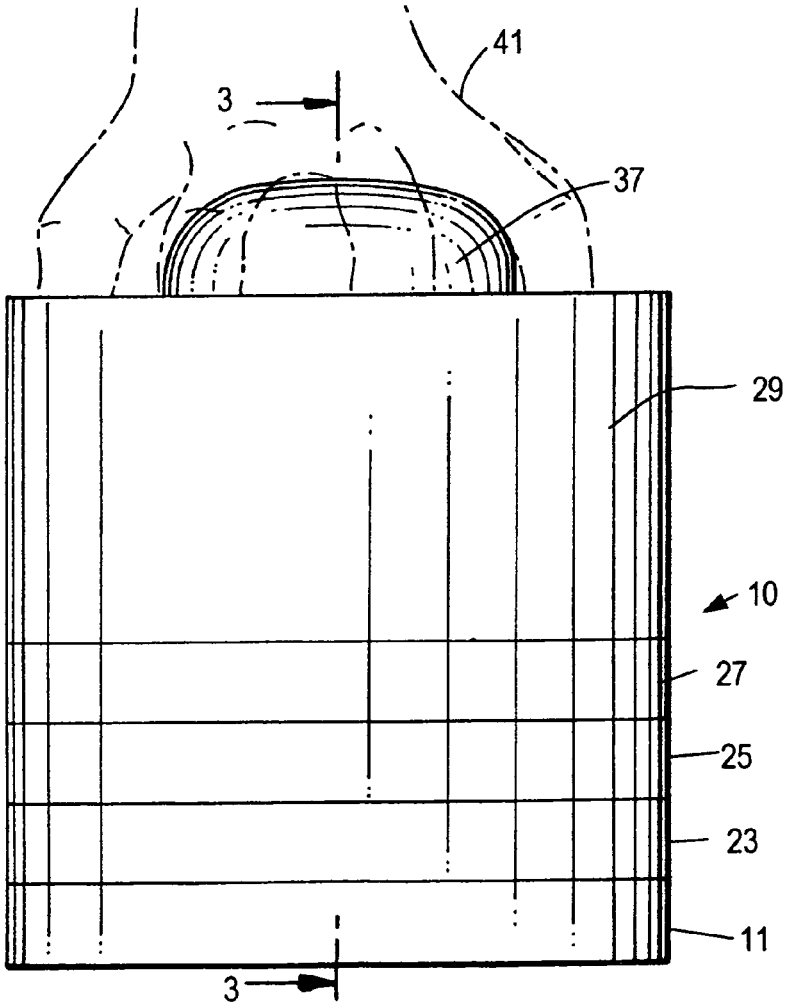
FIG. 2 is a side view of the exercise device of the present invention.
Figure 4:
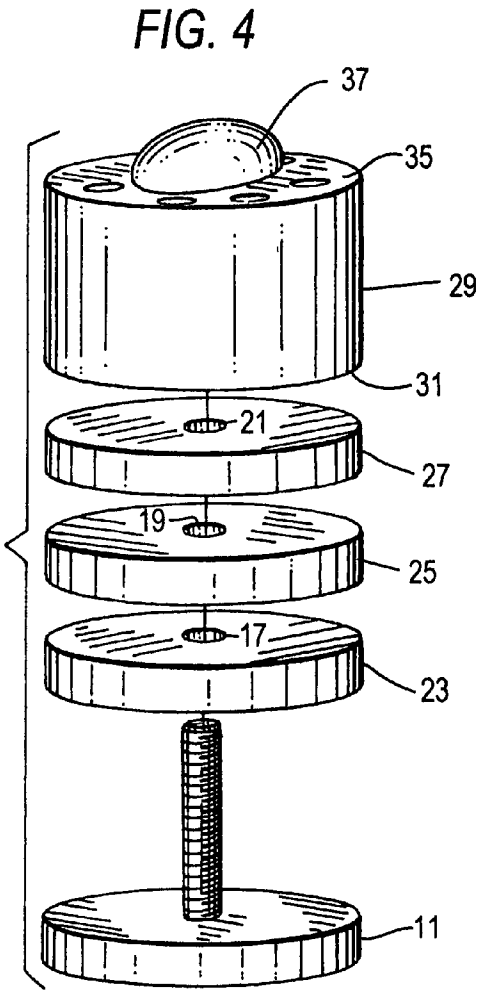
FIG. 4 is an exploded, perspective view of the device of this invention.
Figure 3:
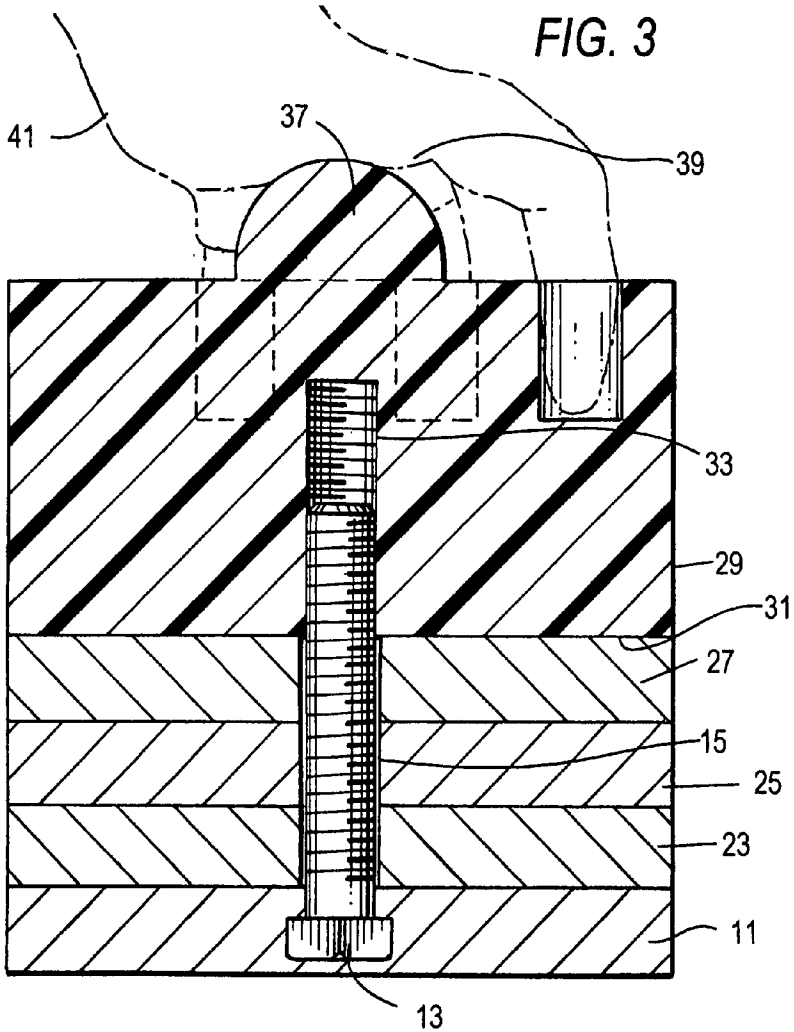
FIG. 3 is a sectional view taken along the line 3-3 of FIG. 2.

Referring to the drawings, the device of the present invention generally designated as 10 has a locking support base 11 and a central mounting bolt 13 having an externally threaded stem 15 extending vertically upward, through centrally aligned holes 17, 19 and 21 formed in the center of the respective superposed plates 23, 25 and 27. Although the device shown in the drawings has three plates, the number of plates as well as their respective thickness and weight can be varied to accommodate the exerciser. Superposed upon the top plate 27 is a hand grip plate 29 having a lower mating surface 31 including a counter bore 33 (not shown) internally threaded so as to threadedly engage the external threaded part of the upper end of threaded stem 15, which partially extends through counter bore 33. The top surface 35 of the upper hand grip plate 29 has a central dome shaped, spherical or semi-spherical, palm support 37 adapted to be gripped or held with the palm 39 of the exerciser's hand 41. As shown in FIG. 1, the top surface 35 of the hand grip plate 29 has five finger gripping holes 43, 45, 47, 49 and 51, conveniently sized to insert the fingers of the exerciser in each hole in order to be able to lift the entire device as desired during the exercise.

As it can be appreciated from the foregoing description, the exercise device of the present invention can be varied in dimensions and weight at the option of the exerciser, and may be used at home and is easily transported from one place to another, as may be used without the need for a trainer. The exercise device of the present invention may be made from various types of materials such as metal, wood or plastic.

In order to use the device of the present invention, the exerciser grips the dome shaped palm support 39 by the palm of his hand, insert his fingers in the finger gripping holes 43, 45, 47, 49 and 51 and raises the device to a predetermined height, depending on the strength of the exercise and then lowers the device to its initial position. The exerciser can raise and lower the device as many times as desired, or if used for therapy purposes, as may be recommended by a trainer.

The invention claimed is:

1. An exercise device for exercising the hands, wrists, arms and fingers of an exerciser comprising a plurality of superposed plates of predetermined size, weight and dimensions, each plate having a central bore aligned with the plate adjacent thereto, a bottom support plate, a mounting bolt affixed to said bottom support plate, an externally threaded stem having a lower end affixed to said mounting bolt, said externally threaded stem extending vertically through said central bore in each of said superposed plates, a hand gripped upper plate having a lower surface in mating relation to an upper surface of a top plate, said hand grip upper plate including an internally threaded bore wherein an upper end of said externally threaded stem is adapted to be threadedly engaged into said internally threaded bore, a dome shaped palm support at a center of an upper surface of said hand gripped upper plate adapted to be gripped by a palm of the exerciser's hand, and a plurality of finger gripping holes distributed around said dome shaped palm support for inserting the fingers of the exerciser to assist the lifting of the device during exercise.

2. A device as in claim 1 wherein each of said plates is of equal weight and size as the other superposed plates.

3. A device as in claim 1 wherein said plates are different in weight, size or dimension.

* * * * *